US006486784B1

(12) United States Patent
Beckers

(10) Patent No.: US 6,486,784 B1
(45) Date of Patent: Nov. 26, 2002

(54) PROCESS AND SYSTEM ENABLING THE BLIND OR PARTIALLY SIGHTED TO FIND THEIR BEARINGS AND THEIR WAY IN AN UNKNOWN ENVIRONMENT

(76) Inventor: Fabien Beckers, 21, rue Guenigaud, Paris 75006 (FR)

( * ) Notice: Subject to any disclaimer, the term of this patent is extended or adjusted under 35 U.S.C. 154(b) by 0 days.

(21) Appl. No.: 09/555,202

(22) PCT Filed: Nov. 24, 1998

(86) PCT No.: PCT/FR98/02518

§ 371 (c)(1),
(2), (4) Date: Jul. 18, 2000

(87) PCT Pub. No.: WO99/27883

PCT Pub. Date: Jun. 10, 1999

(30) Foreign Application Priority Data

Dec. 1, 1997 (FR) ..... 97 15352

(51) Int. Cl.[7] ..... G08B 23/00

(52) U.S. Cl. ..... 340/573.1; 340/944; 340/825.19; 340/572.1; 340/407.1; 340/407.2; 434/112; 342/24

(58) Field of Search ..... 340/944, 825.19, 340/539, 572.1, 573.1, 825.49, 407.1, 407.2, 988, 990; 434/116, 112; 235/379; 342/24; 704/271, 258; 701/217, 200, 201

(56) References Cited

U.S. PATENT DOCUMENTS 4,025,922 A * 5/1977 Trawick, III ..... 342/24
4,660,022 A * 4/1987 Osaka ..... 340/384.3
5,032,083 A * 7/1991 Friedman ..... 434/112
5,144,294 A * 9/1992 Alonzi et al. ..... 340/825.49
5,470,233 A 11/1995 Fruchterman et al. ..... 434/116
5,508,699 A 4/1996 Silverman ..... 340/944
5,616,901 A * 4/1997 Crandall ..... 235/379
5,717,392 A * 2/1998 Eldridge ..... 340/996
5,806,017 A * 9/1998 Hancock ..... 701/209
5,807,111 A * 9/1998 Schrader ..... 434/112
5,936,528 A * 8/1999 Kobayashi et al. ..... 340/572.5
5,973,618 A * 10/1999 Ellis ..... 340/990
6,097,305 A * 8/2000 Im et al. ..... 340/825.19
6,317,715 B1 * 11/2001 Suzuki ..... 704/271

FOREIGN PATENT DOCUMENTS

| | | |
|---|---|---|
| DE | 41 40 976 | 7/1992 |
| EP | 338 997 | 10/1989 |
| EP | 774 245 | 5/1997 |
| GB | 2 287 535 | 9/1995 |

* cited by examiner

*Primary Examiner*—Benjamin C. Lee
(74) *Attorney, Agent, or Firm*—Merchant & Gould, P.C.

(57) ABSTRACT

The invention concerns a method and a system enabling the blind and the partially sighted to direct themselves and find their way in unknown surroundings. Said method consists in teletraining using a portable sensor in particular touch-sensitive or audio, the blind or partially sighted person about the path he must follow to move from one point to another, avoiding obstacles. Said method enables the blind or partially sighted person, having no material landmark which he could remember and recognize by feeling his way with his walking stick, to find his way particularly in streets of a town, in the corridors of an underground railway or of a building.

11 Claims, 5 Drawing Sheets

Figure 1:
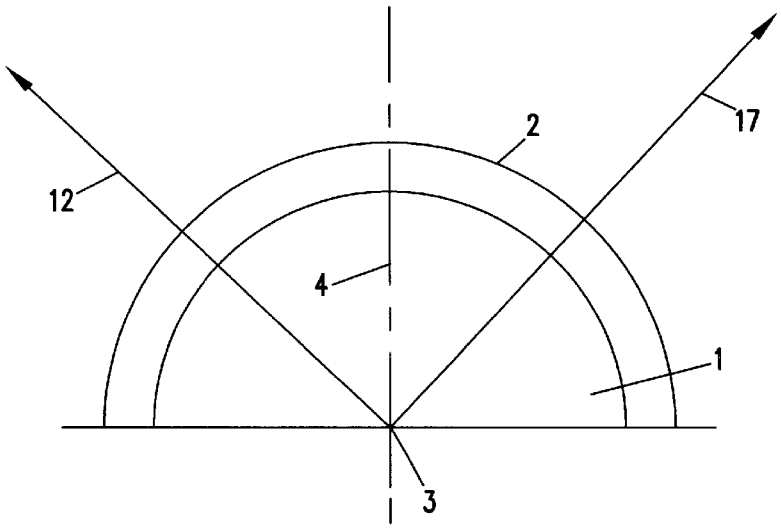

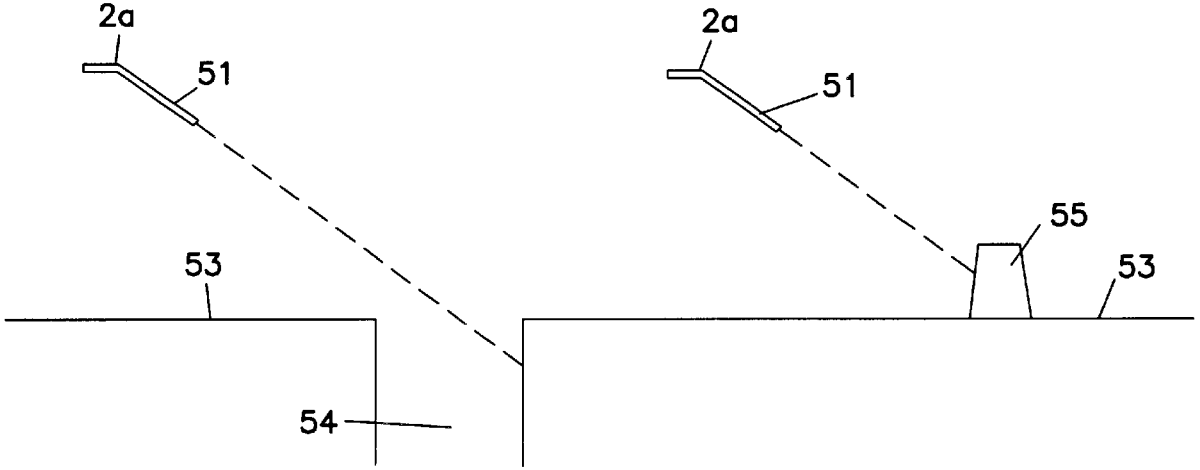
FIG. 6
FIG. 7
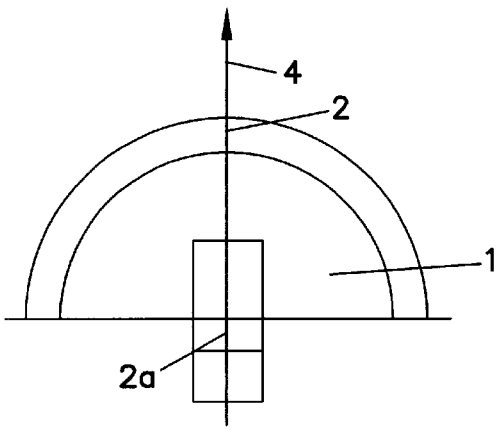
FIG. 8

PROCESS AND SYSTEM ENABLING THE BLIND OR PARTIALLY SIGHTED TO FIND THEIR BEARINGS AND THEIR WAY IN AN UNKNOWN ENVIRONMENT

The present invention relates to processes and systems enabling blind or partially sighted subjects to find their bearings, without the assistance of a third person, in a completely unfamiliar environment, particularly in a building or in a street.

How can a blind or partially sighted subject be given the same autonomy as a sighted subject "discovering" a place they have never been before for the first time? This is the problem related to the present invention. This problem is particularly difficult to solve since the blind or partially sighted subject does not have any material bearing that could be remembered or recognised through touch. People are surprised by the idea that a blind subject could enjoy the same degrees of freedom as a sighted subject in an unknown place. The present invention, by placing sighted and blind or partially sighted subjects at the same level, overcomes a taboo.

Processes and systems using GPS (Global Positioning System) techniques to determine a subject's position are known. Such techniques are envisaged to enable blind or partially sighted subjects to find out their position in an unknown place and determine their route in relation to the obstacles on their path. This solution is not satisfactory for locations (particularly building or underground transport system passages) where GPS satellite links are not functional.

The process according to the invention enables blind or partially sighted subjects to find their bearings and way in an unknown environment, avoiding obstacles. Said process consists of remotely informing the blind or partially sighted subject of the path to follow, to move from one point to another, by means of a portable sensor, particularly of the tactile or audio type, receiving information from local transmitters.

In a first embodiment, said process comprises the following steps consisting of:

- positioning along the path followed by the blind or partially sighted subject a plurality of local micro-transmitters particularly in the form of transmitting chips,
- transmitting, by means of the transmitting chips, bearing information concerning the path to follow to reach the destination selected by the blind or partially sighted subject.

The blind or partially sighted subject is provided with a portable object. Said portable object makes it possible to implement the following steps of the process according to the invention:

- the step consisting of determining the direction of movement of the blind or partially sighted subject with reference to a bearing, particularly the magnetic north,
- the step consisting of selecting a destination,
- the step consisting of receiving the bearing information transmitted by the transmitting chips concerning the path to follow to reach the selected destination,
- the step consisting of calculating the direction to follow according to the direction of the bearing, the selected destination and the bearing information received concerning the path to follow,
- the step consisting of transmitting the direction to follow to the blind or partially sighted subject, particularly using audio signals or tactile information.

In a second embodiment, said process consists of providing the blind or partially sighted subject with a portable object, interacting with the ground and/or obstacles in the vicinity, making it possible to:

- determine the reference distance of the portable object with reference to the ground,
- calculate the distance, with reference to the portable object, of an obstacle located on the blind or partially sighted subject's path,
- compare the distance of the obstacle to the reference distance and detect hollow obstacles and/or raised surface obstacles,
- transmit the topographical characteristics of the obstacle on his/her path to the blind or partially sighted subject, particularly using tactile information.

The invention also relates to a system enabling blind or partially sighted subjects to find their bearings and way in an unknown environment, avoiding obstacles. Said system comprises means to remotely inform the blind or partially sighted subject of the path to follow, to move from one point to another, by means of a portable sensor, particularly of the tactile or audio type, receiving information from local transmitters.

In a first embodiment, said system comprises a plurality of micro-transmitters, particularly in the form of chips positioned along the path to be followed by blind or partially sighted subjects. Said chips comprise:

- a memory containing bearing information concerning their position and the path to follow, and
- transmission means to transmit said bearing information.

The system also comprises a portable object provided to blind or partially sighted subjects. Said portable object comprises:

- means to receive the information transmitted by the micro-transmitters,
- means to select a destination,
- calculation means to calculate:
  - the direction of movement of blind or partially sighted subjects with reference to the direction of a bearing, particularly a compass,
  - the direction to follow according to the direction of the bearing, the selected destination and the information transmitted by the micro-transmitters,
- means for transmitting the direction to follow to blind or partially sighted subjects, particularly tactile means or audio means.

The micro-transmitters are autonomous and programmed according to their position.

Preferably, the micro-transmitters are not powered. Advantageously, the portable object comprises means to create and radiate an electromagnetic field. The micro-transmitters receive their electrical energy from the electromagnetic field created by the portable object.

In a second embodiment, said system comprises a portable object provided to the blind or partially sighted subject. Said portable object comprises calculation means:

- to calculate the reference distance of the portable object with reference to the ground,
- to calculate the distance, with reference to the portable object, of an obstacle located on the blind or partially sighted subject's path.

Said portable object also comprises:

- means to compare the distance of the obstacle to the reference distance and detect hollow obstacles and/or raised surface obstacles, means to transmit the topographical characteristics of the obstacle on his/her path to the blind or partially sighted subject, particularly using tactile information.

The invention also relates to a portable object intended to implement the system described above.

The invention also relates to a micro-transmitter intended to implement the system described above.

Figure 2:
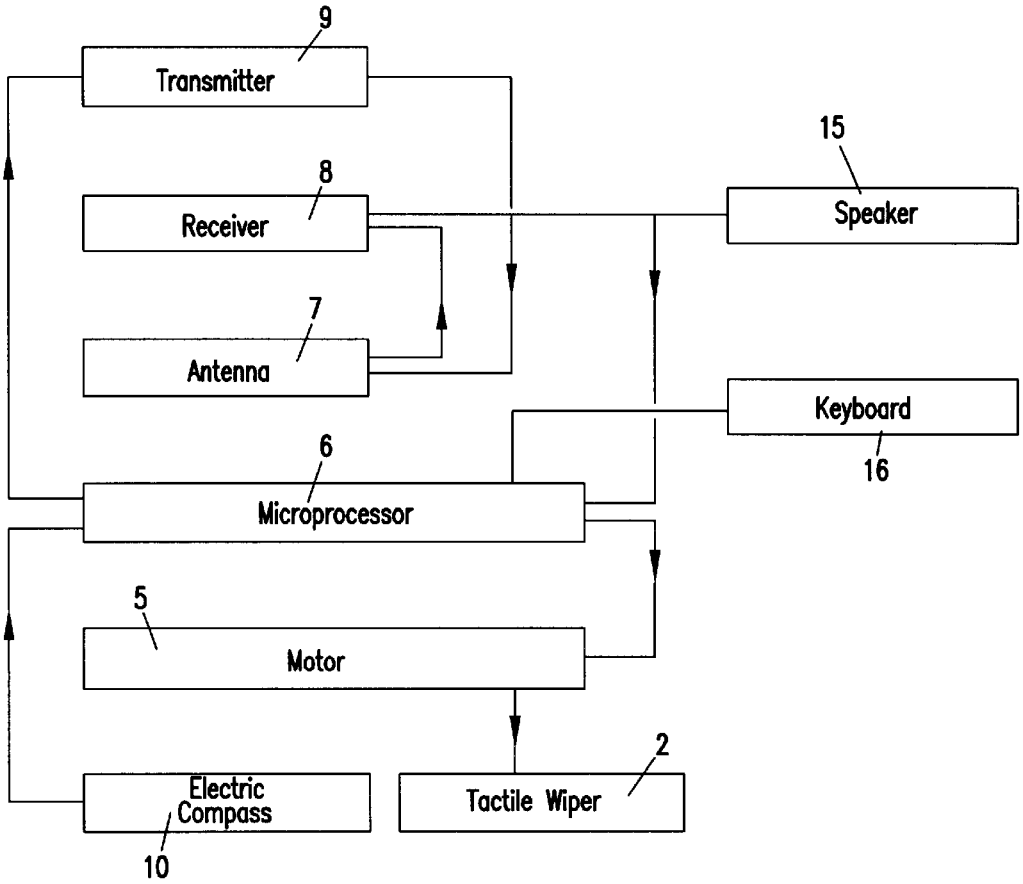
Figure 3:
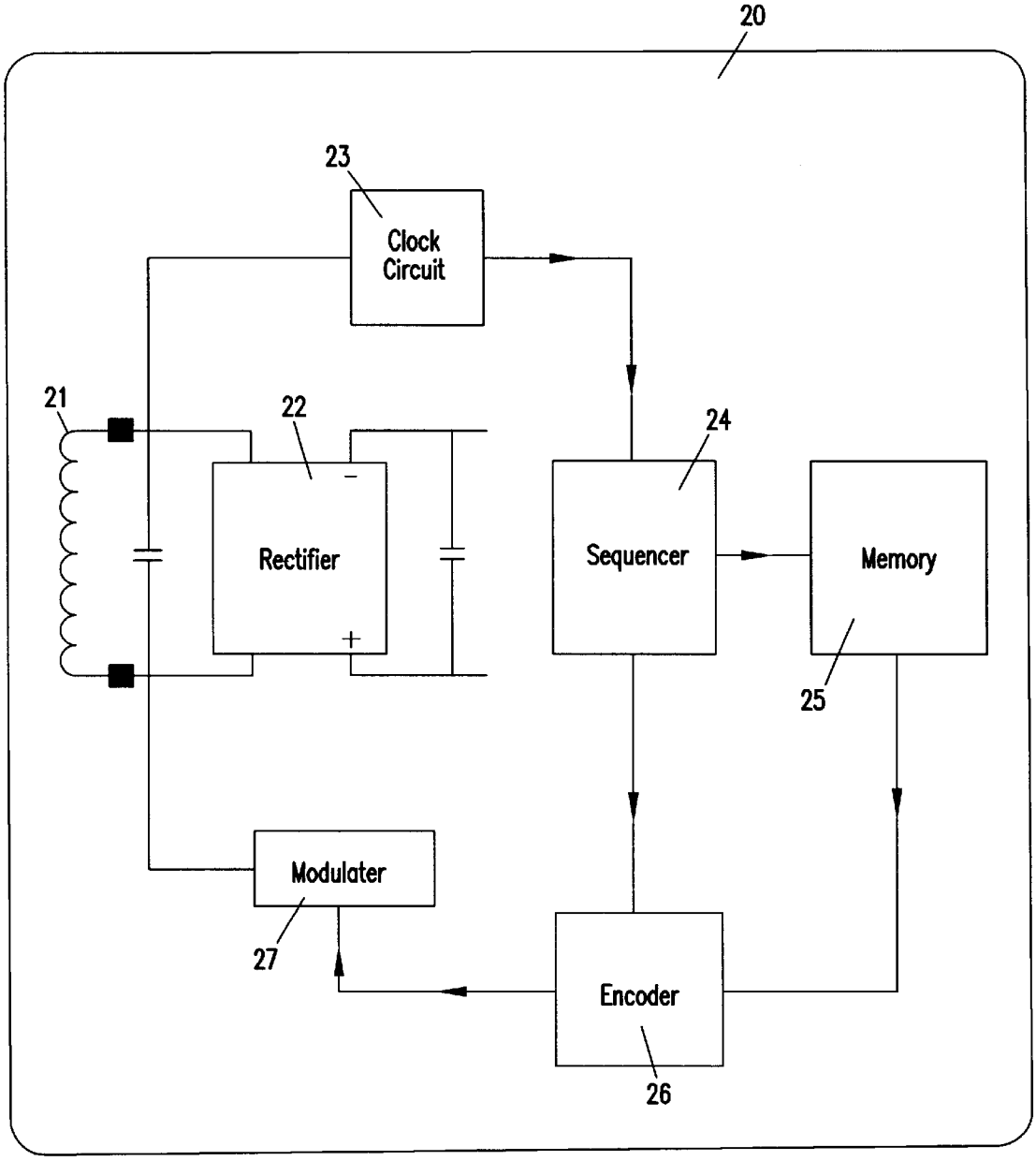
Figure 4:
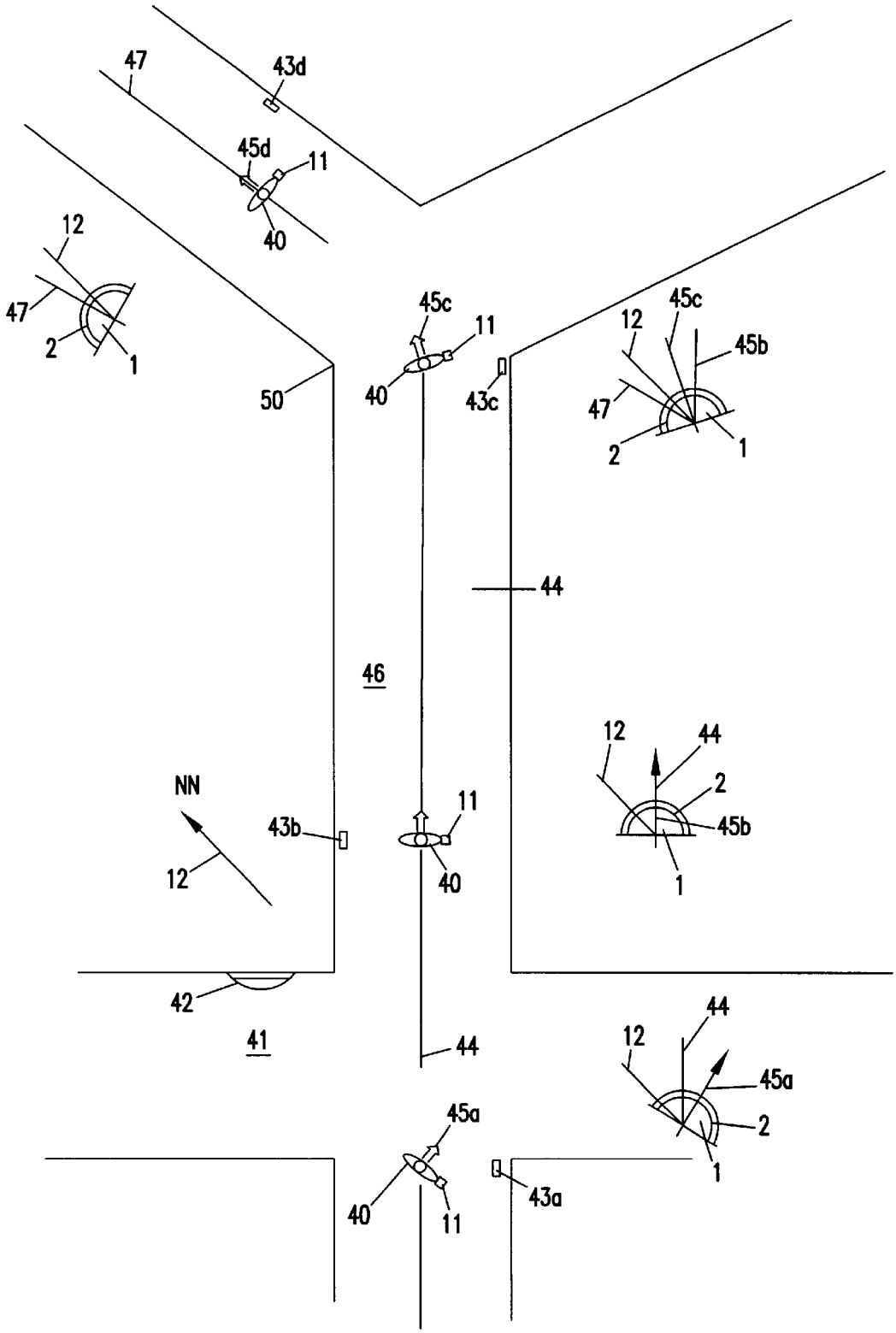

The invention's other characteristics and advantages will be illustrated in the description of the variants of the embodiments of the invention, given as indicative and non-restrictive examples, and in:

FIG. 1 showing a top view of the tactile unit,

FIG. 2 showing, in block diagram form, the functional diagram of the guiding system for blind subjects, FIG. 3 showing a schematic view of a transmitting chip, FIG. 4 showing a schematic view of the entrance hall and passage of an underground transport system, through which the blind subject walks using a tactile unit, FIGS. 5, 6, 7 and 8 showing a schematic view of the blind subject using a telemetric stick equipped with a tactile sensor to detect hollow or raised surface obstacles located in the subject's path.

We will now describe FIG. 1 which represents a top view of the tactile unit. The semi-cylindrically shaped tactile unit 1 is preferably fitted on the blind subject's stick and placed within the subject's hand's reach. The tactile unit 1 comprises a tactile wiper 2 (that the blind or partially sighted subject can feel). This wiper pivots around an axis 3 plus 90° or minus 90°, respectively, to the right or to the left, with reference to the median axis 4 of the tactile unit 1. Conventionally, when the wiper 2 is oriented along the median axis 4 of the tactile unit 1, the blind or partially sighted subject knows that he/she is walking in the correct direction.

Figure 5:
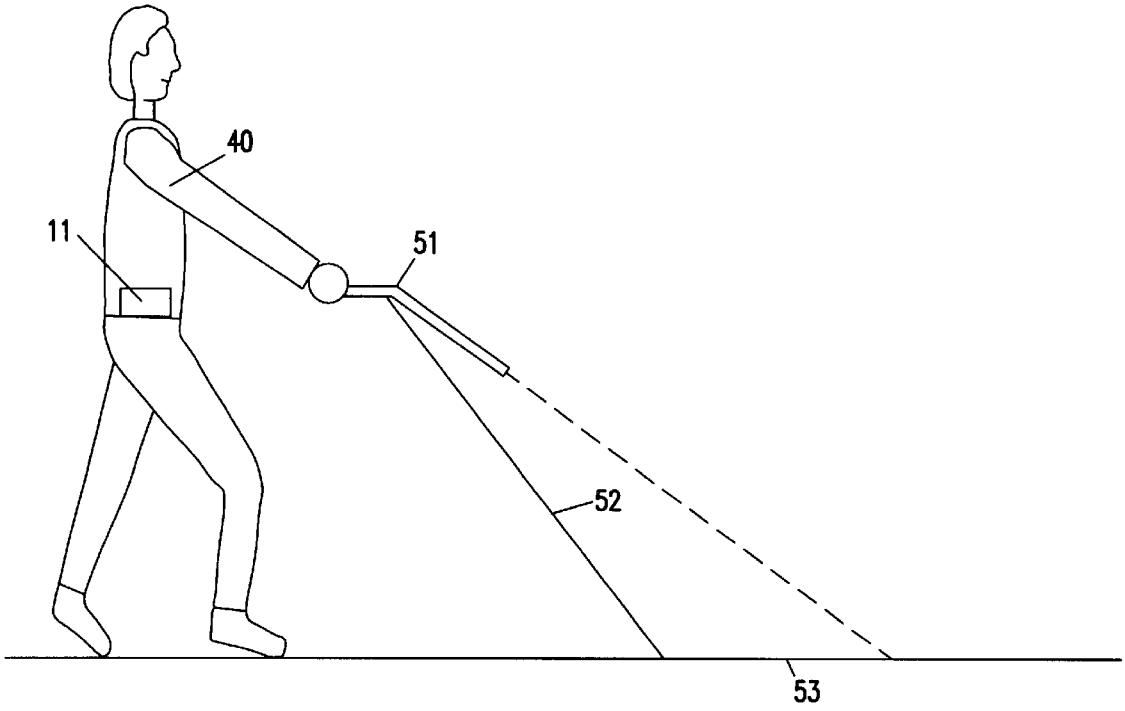

We will now describe FIG. 2 which represents, in block diagram form, the functional diagram of the guiding system for blind subjects. The wiper 2 is actuated by a motor 5, the rotation of which is controlled by a microprocessor 6. This microprocessor receives the bearing data from the chips 20 (see FIG. 3) via an antenna 7 and a receiver 8. The microprocessor 6 controls the transmission of the electromagnetic field generated by the transmitter 9 and the antenna 7. The guiding system also comprises an electronic compass 10. An electrical power supply (not shown), particularly a battery or rechargeable battery, supplies the power required for the operation of the guiding system and the creation of the electromagnetic field transmitted by the antenna 7. Preferably, the microprocessor 6, the antenna 7, the receiver 8, the transmitter 9, the electronic compass 10 and the electrical power supply are fitted in a unit 11 worn on the blind subject's hip or back (FIGS. 4 and 5). The electronic compass 10 continuously supplies the microprocessor 6 with data enabling it to calculate the angle formed by the blind subject's median plane with the Magnetic North MN 12. The tactile unit 1 fitted on the blind subject's stick is interconnected with the unit 11 by flexible links (cables or electromagnetic links). In this way, the data calculated by the microprocessor 6 may be transmitted to the motor 5 actuating the wiper 2 when the blind subject moves forward by scanning the zone in front of him/her with his/her stick. It is important to note before continuing the description that, conventionally, when the blind or partially sighted subject is moving in the correct direction, the wiper 2 is located on the median axis 4 of the tactile unit 1. Even if the blind subject turns his/her hand and stick to the right without pivoting his/her body, the wiper 2 remains on the median axis 4 of the tactile unit 1. However, for more convenience, the blind subject may move his/her hand holding the stick such that the median axis 4 of the tactile unit 1 is perpendicular to the direction of his/her shoulder and parallel to the direction of movement. Indeed, when the tactile unit occupies this position, the wiper 2 is oriented in the direction of movement. In the rest of the description, it is assumed that the tactile unit occupies this position.

We will now describe FIG. 3 which represents a schematic view of a transmitting chip. The electronic chips 20 operate without a power supply and are relatively inexpensive to produce. As also seen with reference to FIG. 4, they are positioned along the path to be followed by blind or partially sighted subjects. They may be attached, for example, to the walls of underground transport system passages. They receive their energy from the electromagnetic field transmitted by the antenna 7 of the unit 11 by means of an induction coil 21. The alternating current from the coil 21 is rectified by a rectifier 22 so as to produce the direct current required for the operation of the electronic circuit contained in the chip. The clock circuit 23 extracted from the signal picked up by the coil 21 is a clock signal controlling a sequencer 24. The sequencer 24 supplies the address signals of the memory 25 (containing the bearing data to be transmitted) and the signals required for the encoding by the encoder 26 of the data transmitted by the chip 20. The encoder 26 controls the operation of the modulator 27, which generates the electric current modulating the electromagnetic field transmitted by the coil 21 according to the bearing data to be transmitted. Through this combination of means, the chips 20 transmit a code composed of two parts:

the first part (a letter) corresponds to the path selected by the blind subject, the second part (a number) corresponds to the direction to follow.

The number varies from 0 to 12 according to the following correspondence table with the angle (calculated trigonometrically) formed by the direction to follow 17 with the direction of the Magnetic North MN 12:

| Number | Angle |
|---|---|
| 0 | +180° |
| 1 | +160° |
| 2 | +120° |
| 5 | +60° |
| 6 | +30° |
| 7 | 0° |
| 8 | −30° |
| 9 | −60° |
| 10 | −90° |
| 11 | −120° |
| 12 | −160° |

We will now describe the operation of the system according to the invention. The selected location in this case is the Paris Metro system, but the system is operational and applicable to any infrastructure. It may be adapted to streets, buildings, etc. FIG. 4 represents a schematic view of the entrance hall and a passage of the Metro system. The blind subject 40 arrives in the hall 41 of the departure station. In the latter, a low-range radio transmitter 42, playing a looped message indicating the different possible destinations, is positioned. A letter is associated with each route. Example of message:

"You are at the Odéon station in front of the main counters, you can go to

| | |
|---|---|
| the Gare d'Austerlitz line platform: | letter A |
| the Boulogne line platform: | letter B |
| the Porte de Clignancourt line platform: | letter C |
| or the Porte d'Orléans line platform: | letter D" |

The unit 11, worn on the blind subject's hip, also comprises a receiver 8 and a speaker 15. The subject can thus hear the message transmitted by the radio transmitter 42. The unit 11 comprises a keyboard 16 comprising keys marked with letters, analogous to those mentioned in the message, corresponding to the different possible destinations. After listening to the message, once the destination has been chosen, the blind subject selects, using the keys on the keyboard 16, the letter linked to the selected route. For example, if the subject wants to go to the Boulogne line platform, he/she presses the key marked with the letter B.

The guiding phase starts once the destination has been selected as described above. The electromagnetic field created by the transmitter 9 and the antenna 7 activates the chip 43*a* located in the hall. The microprocessor 6 receives, analyses and memorises in its memory zone, the two-part code transmitted by the chip 43*a*. In the example described, the first part, the letter (in this case, B) corresponds to the recorded destination. At stage (a) of the movement, initially in the example described, the angle formed by the direction to follow 44 and the Magnetic North 12 is −30°. Therefore, the chip 43*a* transmits the number 8 (see correspondence table above). The blind subject 40 moves forward in the direction 45*a* and the angle formed by the direction of movement 45*a* and the direction of the Magnetic North 12 is −60°. The tactile wiper 2 is positioned along the median axis of the unit, i.e. along the direction of movement 45*a*. On the right of the blind subject 40, an enlarged view of the tactile unit 1 at stage (a) of movement is represented. Apparently, the direction of movement of the blind subject is not correct. It forms an angle with the direction to follow that can be calculated according to the algebraic equation:

angle (direction to follow, direction of movement)=angle (direction of movement, direction of Magnetic North)−angle (direction to follow, direction of Magnetic North).

Giving, in the case in question, an angle of: −60°−(−30°)=−30°.

The microprocessor 6 calculates this angle and sends the motor 5 the instruction to turn the wiper 2 (to the left) by an opposite angle, equal to +30°, so that it is again aligned with the direction to follow. The blind subject feels the wiper turn to the left and pivots in the same direction. As the blind subject pivots, the microprocessor recalculates the angle by which the wiper 2 is to turn. When the blind subject has pivoted by an angle of +30°, the angle formed by the direction of movement with the Magnetic North will be −30°. The microprocessor then checks, by applying the above equation, that the angle between the direction of movement and the direction to follow is zero: −30°−(−30°)=0. The wiper remains in the median position. It should be noted that the microprocessor 6 continuously calculates the angle between the direction of movement and the direction to follow (memorised in the microprocessor's memory zone as described above). Any deviation induces a rotation of the wiper 2 immediately notified to the blind subject. If, following an incident on his/her path (knocking against another person), the blind subject moves away from his/her path by pivoting, he/she will therefore be returned to the correct direction, according to the same process as described in stage (a).

The blind subject continues to move forward and enters the passage 46. When he/she is in the vicinity of the chip 43*b*, stage (b), the microprocessor 6 receives new bearing information. In the example described, the code transmitted by the chip 43*b* is always the number 8, indicating that the direction to follow 44 has not changed with reference to the direction of the Magnetic North and forms an angle of of −30° with said Magnetic North. It is assumed that the blind subject has not changed direction and is moving in a direction 45*b* still forming the same angle of −30° with the direction of the Magnetic North. The microprocessor calculates, as described above, the angle between the direction of movement and the direction to follow. Since said angle is zero, the wiper remains in the median position. The blind subject then knows that he/she must continue to move in the same direction.

When the blind subject arrives in the vicinity of the chip 43*c*, the microprocessor receives the code indication: number 6, indicating that the direction to follow 47 forms an angle of +30° with reference to the direction of the Magnetic North 12. Since previously, he/she was moving in a direction 45*b* which formed an angle of −30° with reference to the direction of the Magnetic North 12, the microprocessor 6 deduces, by applying the equation:

angle (direction to follow, direction of movement)=angle (direction of movement, direction of Magnetic North)−angle (direction to follow, direction of Magnetic North), the angle of the direction to follow 47 with reference to the direction of movement 45*b* or: −30°−(+30°)=−60°. The microprocessor 6 sends the motor 5 the instruction to turn the wiper 2 (to the left) by an opposite angle, equal to +60°, so that it is again aligned with the direction to follow. The blind subject feels the wiper turn under his/her fingers and pivots to the left. FIG. 4 represents the blind subject pivoting as he/she moves forward. He/she is in an intermediate position, the tactile wiper 2 is still to the left of the median axis 4 of the unit which is also parallel to the direction of movement 45*c*. The blind subject knows that he/she must continue to move forward, continuing to pivot. He/she may use his/her stick to locate the edge 50 of the passage to walk round.

When he/she arrives in the vicinity of the chip 43d, he/she receives the code number 6 indicating that the direction to follow 47 still forms an angle of +30° with reference to the direction of the Magnetic North 12. As he/she continues to pivot, his/her new direction of movement 45*d* now forms an angle of +30° with reference to the direction of the Magnetic North 12. The microprocessor 6 deduces that the angle of the direction to follow 47 with reference to the direction of movement 45*d* is: +30°−(+30°)=0°. The microprocessor 6 does not send any instruction to the motor 5. The wiper 2 is directed along the median axis 4 of the unit 1. The blind subject knows that he/she must continue to move forward without deviating from his/her direction.

In the example illustrated in FIG. 4, the angle formed by the direction of movement with the direction to follow is between −90° and +90°. If this angle is greater than or equal to 90°. or less than or equal to −90°, conventionally, the microprocessor actuates the motor so that the wiper 2 is moved to the right end or to the left end of the unit respectively. The blind subject then knows that he/she must pivot at least 90° to the right or left. This returns the subject to the case illustrated in FIG. 4 where the angle formed by the direction of movement with the direction to follow is between −90° and +90°.

The wiper does not pivot when the blind subject moves forward in a straight line in the correct direction. Then, throughout the route, for branches and turns, the same process is applied. Transmitting chips are attached in front of each fork, turn or change of direction. The receiver 8 receives the codes. Once the route code (still the letter B) has been recognised, the computer determines, from the number transmitted, the angle by which the wiper actuated by the motor is to pivot.

It is important to note that this information is particularly simple to obtain since the tactile unit is positioned on the stick handle, under the subject's fingers. Therefore, by a simple movement of said unit, the blind subject is constantly informed of the movements to follow to reach his/her destination, with no noise nuisance. Upon arrival, another radio transmitter of the same type as the radio transmitter 42 described above informs the user of his/her position, since, in the case of the Metro, as for many locations, the ends of routes are both departures and arrivals, depending on the path leading to them.

We will now describe, with reference to FIGS. 5, 6 and 7, the telemetric stick enabling blind subjects to move from one point to another, avoiding the obstacles in their path. Blind people are afraid of not knowing the location of the holes and small obstacles that abound on pavements, or potential dangers, that they would be unable to detect in spite of their very advanced sense of perception of the environments they are in. These obstacles may be keels to prevent cars from parking, signalling posts, pavement steps, or hollows and sometimes subjects moving towards them too quickly, sometimes resulting in a collision due to lack of attention. The laser type electronic meter 51 is attached to a stick 52, slightly inclined horizontally. It enables the blind subject to scan a certain zone in front of him/her and calculate the reference distance between the electronic meter 51 and the ground 53. If, as represented in FIG. 6, a hole 54 has been produced in the ground 53, the distance between the electronic meter 51 will necessarily be greater than the reference distance. If, in FIG. 7, instead of the hole, there is a post or a keel 55, the distance between the electronic meter and the obstacle will be less than the reference distance. Therefore, comparing the measured distance to the reference distance makes it possible to determine whether the obstacle is a "cavity" or "raised surface" type obstacle. According to the differences measured, obstacles are classified by order of difficulty. It is possible to inform the blind subject by actuating, according to the measurements made by the electronic meter 51, a tactile element such as the wiper 2*a* of the unit 1 (FIG. 8). Conventionally, a forward movement of the wiper 2*a* indicates that the obstacle is on a raised surface. The greater the movement, the greater the amplitude of the obstacle.

In the example described, the means to determine the direction of a bearing is a compass. Other means may be envisaged, particularly a gyroscope. It is also possible to use satellites and transmitting markers on the ground.

The blind subject's position and direction of movement may be determined with reference to a map of the location he/she is in. This map may be supplied to the blind or partially sighted subject in the form of a CD-ROM read by a portable drive. It may also be transmitted remotely by transmitters positioned such that their transmissions can be received by the electronic equipment carried by the blind or partially sighted subject.

What is claimed is:

1. System enabling blind or partially sighted subjects (40) to find their bearings and way in an unknown environment (41, 46), said system comprising:

firstly, a plurality of micro-transmitters (20, 43*a*, 43*b*, 43*c*, 43*d*), particularly in the form of chips positioned along the path (41, 46) to be followed by blind or partially sighted subjects; said chips comprising a memory (25) containing bearing information concerning the position and the path to follow, and transmission means (26, 27) to transmit said bearing information, secondly, a portable object (1, 11) provided to blind or partially sighted subjects comprising (40), means to receive (7, 8) the information transmitted by the micro-transmitters (20), means to select (16) a destination, calculation means (6)

to calculate the direction of movement (45*a*, 45*b*, 45*c*, 45*d*) of blind or partially sighted subjects with reference to the direction of a bearing (12), particularly a compass, and to calculate the direction to follow (17, 44, 47) according to the direction of the bearing (12), the selected destination and the information transmitted by the micro-transmitters (20), means for transmitting (2) the direction to follow (17, 44, 47) to blind or partially sighted subjects (40), particularly tactile means or audio means.

2. System according to claim 1, such that the micro-transmitters (20) are autonomous and programmed according to their position.

3. System according to claim 2, such that the micro-transmitters (20) are not powered.

4. System according to claim 3, such that the portable object (1, 11) comprises means to create (9) and radiate (7) an electromagnetic field, the micro-transmitters (20) receive their electrical energy from the electromagnetic field created by the portable object (1, 11).

5. Process enabling blind or partially sighted subjects (40) to find their bearings and way in an unknown environment (41, 46), particularly in the passages of an underground transport system station, said process comprising steps consisting of:

positioning, along the path (41, 46) followed by the blind or partially sighted subject, a plurality of local micro-transmitters particularly in the form of transmitting chips (20), transmitting, by means of the transmitting chips (20), bearing information concerning the path to follow to reach the destination selected by the blind or partially sighted subject;

the blind or partially sighted subject being provided with a portable object (1, 11) to implement the following steps of the process:

the step consisting of determining the direction of movement (45*a*, 45*b*, 45*c*, 45*d*) of the blind or partially sighted subject (40) with reference to a bearing (12), particularly the magnetic north, the step consisting of selecting (16) a destination, the step consisting of receiving (7, 8) the bearing information transmitted by the transmitting chips concerning the path to follow to reach the selected destination, the step consisting of calculating (6) the direction to follow (17, 44, 47) according to the direction of the bearing (12), the selected destination and the bearing information received concerning the path to follow, the step consisting of transmitting (2, 15) the direction to follow to the blind or partially sighted subject, particularly using audio signals or tactile information.

6. Portable object (1, 11) intended to co-operate with a plurality of micro-transmitters (20, 43*a*, 43*b*, 43*c*, 43*d*) to enable blind or partially sighted subjects (40) to find their bearings and way in an unknown environment (41, 46); said micro-transmitters, particularly in the form of chips, being positioned along the path (41, 46) to be followed by blind or partially sighted subjects; said micro-transmitters comprising a memory (25) containing bearing information concerning the position and the path to follow, and transmission means (26, 27) to transmit said bearing information;

said portable object (1, 11) provided to blind or partially sighted subjects being characterised in that it comprises, means to receive (7, 8) the information transmitted by the micro-transmitters (20), means to select (16) a destination, calculation means (6)

to calculate the direction of movement (45*a*, 45*b*, 45*c*, 45*d*) of blind or partially sighted subjects with reference to the direction of a bearing (12), particularly a compass, and to calculate the direction to follow (17, 44, 47) according to the direction of the bearing (12), the selected destination and the information transmitted by the micro-transmitters (20), means for transmitting (2) the direction to follow (17, 44, 47) to blind or partially sighted subjects (40), particularly tactile means or audio means.

7. Portable object according to claim 6 such that it comprises means to create (9) and radiate (7) an electromagnetic field; said micro-transmitters (20) receiving their electrical energy from the electromagnetic field created by the portable object (1, 11).

8. Micro-transmitter (20, 43*a*, 43*b*, 43*c*, 43*d*) intended to co-operate with a portable object (1, 11) to enable blind or partially sighted subjects (40) to find their bearings and way in an unknown environment (41, 46);

said micro-transmitter particularly taking the form of a chip; said micro-transmitter chips being intended to be positioned along the path (41, 46) to be followed by blind or partially sighted subjects;

said micro-transmitter being characterised in that it comprises, a memory (25) containing bearing information concerning its position and the path to follow, and transmission means (26, 27) to transmit said bearing information;

said portable object (1, 11) provided to blind or partially sighted subjects being characterised in that it comprises, means to receive (7, 8) the information transmitted by the micro-transmitters (20), means to select (16) a destination, calculation means (6)

to calculate the direction of movement (45*a*, 45*b*, 45*c*, 45*d*) of blind or partially sighted subjects with reference to the direction of a bearing (12), particularly a compass, and to calculate the direction to follow (17, 44, 47) according to the direction of the bearing (12), the selected destination and the information transmitted by the micro-transmitter (20), means for transmitting (2) the direction to follow (17, 44, 47) to blind or partially sighted subjects (40), particularly tactile means or audio means.

9. Micro-transmitter according to claim 8 characterised in that it is autonomous and programmed according to its position.

10. Micro-transmitter according to any of claims 8 or 9 characterised in that it is not powered.

11. Micro-transmitter according to claim 10 characterised in that it receives its electrical energy from an electromagnetic field created by the portable object (1, 11).

* * * * *